US006284707B1

(12) United States Patent
Midorikawa et al.

(10) Patent No.: US 6,284,707 B1
(45) Date of Patent: Sep. 4, 2001

(54) THERMALLY SENSITIVE RECORDING MEDIUM

(75) Inventors: Yoshimi Midorikawa; Kaoru Hamada; Yoshihide Kimura, all of Shinjuku-ku; Tomoaki Nagai, Kita-ku, all of (JP)

(73) Assignee: Nopon Paper Industries Co Ltd, Tokyo (JP)

( * ) Notice: Subject to any disclaimer, the term of this patent is extended or adjusted under 35 U.S.C. 154(b) by 0 days.

(21) Appl. No.: 09/342,924

(22) Filed: Jun. 30, 1999

(30) Foreign Application Priority Data

Jul. 3, 1998 (JP) ..... 10-188334

(51) Int. Cl.[7] ..... B41M 5/30

(52) U.S. Cl. ..... 503/220; 503/204; 503/221; 503/217

(58) Field of Search ..... 503/204, 220, 503/216, 217, 221

(56) References Cited

U.S. PATENT DOCUMENTS 5,468,855 * 11/1995 Zink ..... 544/60

5,627,287 * 5/1997 Sasaki et al. ..... 548/463

OTHER PUBLICATIONS

Japanese Laid–open Publication 05–278328 (English abstract).

Japanese Laid–open Publication 10–315636 (English abstract).

Japanese Laid–open Publication 09–221832 (English abstract).

* cited by examiner

*Primary Examiner*—Bruce H. Hess

(57) ABSTRACT

The thermally sensitive recording medium having sufficient color developing density and develops navy blue or grayish blue color. The color difference L* value a* value and b* value of developed image of said thermally sensitive recording medium regulated by JIS-Z-8729 are within the regions of, A. L* value is 30~50, a* value is −15~0 and b* value is −30~10, B. L* value is 30~50, a* value is 0~10 and b* value is −30~0 or C. L* value is 30~50, a* value is 10~20 and b* value is −30~15.

10 Claims, No Drawings

THERMALLY SENSITIVE RECORDING MEDIUM

BACKGROUND OF THE INVENTION

The present invention relates to a thermally sensitive recording medium which develops navy blue or grayish blue color.

DESCRIPTION OF THE PRIOR ART

Generally, the thermally sensitive recording medium possessing a thermally sensitive recording layer mainly comprising a colorless or a pale colored electron donating dye precursor (hereinafter shortened to dye precursor) and a color developer which develops color when heated together with said (lye precursor was disclosed in Japanese Patent publication 45-14035 and had been widely utilized practically. As a recording apparatus for this thermally sensitive recording medium, a thermal printer to which a thermal head is installed can be used. The recording method mentioned above has strong points in comparison with other conventional recording methods, namely, noiseless during recording, a developing and a printing procedure are not needle, maintenance free, apparatus is relatively low price and compact and a recorded pattern is very vivid. Therefore, along with the growth of information industry, the application of this method is widely expanded, for instance, applications for a facsimile or a computer, for many kinds of measuring equipment and for a label. The developed color image of these thermally sensitive recording media is mainly black color, however, a red color developing type, a blue color developing type, a green color developing type, a full color developing type and a dual color developing type are also well known.

The developed color of thermally sensitive recording media is comparatively sharp and close to photograph quality, and recently has been used as an output means of image which is taken by a camera attached to a game machine. Accompanied with the extension of uses, a thermally sensitive recording media which develops neutral color such as navy blue color or grayish blue color is coming to be desired. In the conventional field of thermally sensitive recording media, it is commonly observed that the developed color changes to navy blue color or grayish blue color by the effect of environment such as sun light and temperature, or by the effect of chemicals, however, this color change is a phenomenon which is recognized as a problem caused by poor color preserving. And the thermally sensitive recording medium whose original developed color is navy blue color or grayish blue color is not developed yet.

The object of this invention is to provide a thermally sensitive recording medium which has a sufficient color density and develops navy blue or grayish blue color.

To accomplish the above mentioned object, the present invention provides a thermally sensitive recording media having a thermally sensitive color developing layer containing a colorless or a pale colored dye precursor and a color developer as main components on a substrate, wherein the color difference L* value, a* value and b* value regulated by JIS-Z-8729 of developed image of said thermally sensitive recording media are within the regions of, A. L* value is 30–50, a* value is −15–0 and b* value is −30–10, B. L* value is 30–50, a* value is 0–10 and b* value is −30–0, or C. L* value is 30–50, a* value is 10–20 and b* value is −30–15.

The color difference L* value is a parameter which indicates brightness, and when the plus of L* is big, the brightness becomes strong. The color difference a* value is a parameter which indicates green color, and when the minus value of a* is big, the greenish tone is strong. And when the value approaches to 0, the greenish tone becomes weak. Further, plus a* value indicates the reddish tone. Meanwhile, the color difference b* value is a parameter which indicate blue tone and when the minus value of b* is big, the bluish tone of b* strong. When the value is approaches 0, the bluish tone becomes weak, and plus b* value indicates yellowish tone. When the color differences L* value, a* value and b* value, of the developed image of the thermally sensitive recording media of this invention are within the aforementioned regions, the required navy blue or grayish blue color can be obtained. Further, when the color difference L* value is 30–45, a* value color is −15–0 and b* value is −25–10 or a* value color is 0–10 and b* value is −25–0, more vivid color tone can be obtained and desirable. On the contrary, when these color difference values are out of the regions regulated in this invention, the color of developed image becomes blue or black and the aimed color tone can not be obtained.

In this invention, the term of navy blue or grayish blue means dim and dark neutral color tone developing, which is disclosed, e.g., from pages 108 to 111, in items "46 SOFT & DULL BLUE" and "47 GRAYISH BLUE" of "Color one point 10, color naming and it's episode" (Japan Standard Society, issued on Nov. 19, 1993). These colors are expressed as dim blue or dark navy blue by JIS common name, or are expressed as indigo or gray blue by idiomatic color naming. Further, the expression of color becomes different by a subjectivity of inspector or by an illumination, and in this invention, the expression of navy blue or grayish blue color are typically used containing commonly expressed navy blue, cyan color or ultramarine color, however, it is not limited to them.

The invention particularly provides thermally sensitive recording medium as described above, wherein dye precursor includes at least one component selected from 3,3-bis(p-dimethylaminophenyl)-6-dimethylaminophthalide and 3-(4-(diethylamino-2-ethoxyphenyl)-3-(1-ethyl-2-methylindol-3-yl)-4-azaphthalide and at least one black color developing leuco dye whose maximum absorption wave length is from 420~480 nm and 550~640 nm. In this invention, 3,3-bis(p-dimethylaminophenyl)-6-dimethylaminophthalide and 3-(4-dimethylamino-2-ethoxyphenyl)-3-(1-ethyl-2-methylindol-3-yl)-4-azaphthalide are the leuco dye which develops bluish color, and the maximum absorption wave length of this invention is measured in 99% acetic acid solution. Thus, by the combination use of leuco dyes whose maximum absorption wave lengths are different, the thermally sensitive recording media which develops neutral color such as navy blue color or grayish blue color can be easily obtained while maintaining sufficient color developing density.

The invention further provides thermally sensitive recording media containing 0.05–1 parts of black color developing leuco dye whose maximum absorption wave length is 420–480 nm and 550–640 nm to 1 part of 3,3-bis(p-dimethylaminophenyl)-6-dimethylaminophthalide or 3-(4-diethylamino-2-ethoxy phenyl)-3-(1-ethyl-2-methylindol-3-yl)-4-azaphthalide. When the content of black color developing leuco dye is smaller than 0.05 parts to 1 part of bluish color developing leuco dye, the aimed color tone can be obtained, however, the bluish color becomes slightly strong. On the contrary, when the content is bigger than 1 part, the black color becomes slightly strong. Therefore, it is desirable to contain the black color developing leuco dye in the above mentioned ratio to the blue color developing leuco dye to obtain the thermally sensitive recording media whose developed image is vivid navy blue or grayish blue color and the contrast of image is good.

Further, the present invention provides the thermally sensitive recording media which develops navy blue or grayish blue color, and as mentioned above, the aimed color tone of this invention is not limited to the expression of navy blue or grayish blue color.

DETAILED DESCRIPTION OF THE INVENTION

As a leuco dye which develops blue color used in this invention, 3,3-bis(p-dimethylaminophenyl)-6-dimethylaminophthalide or 3-(4-diethylamino-2-ethoxy phenyl)-3-(1-ethyl-2-methylindol-3-yl)-4-azaphthalide are desirably used, however, it is not intended to be limited to them, and other bluish developing leuco dye can be used. These mentioned leuco dyes can be used alone or used together.

As a leuco dye which develops black color which is used in this invention, the leuco dye whose maximum absorption wave length in 99% acetic acid solution is from 420–480 nm and 550–640 nm can be used. As the concrete examples mentioned is made of, 3-(diethylamino-6-methyl-7-anilinofluoran,
3-diethylamino-6-methyl-7-(o.p-dimethylanilino)fluoran,
3-diethylamino-6-methyl-7-(p-chloroanilino)fluoran,
3-diethylamino-6-methyl-7-m-methylanilinofluoran,
3-diethylamino-6-methyl-7-n-octylaminofluoran,
3-diethylamino-6-chloro-7-anilinofluoran,
3-diethylamino-7-(m-trifluoromethylanilino)fluoran,
3-diethylamino-7-(o-chloroanilino)fluoran,
3-diethylamino-7-(o-fluoroanilino)fluoran,
3-diethylamino-6-methyl-7-(p-n-butylanilino)fluoran,
3-dibutylamino-6-methyl-7-anilinofluoran,
3-dibutylamino-6-methyl-7-(o.p-dimethylanilino)fluoran,
3-dibutylamino-7-(o-chloroanilino)fluoran,
3-dibutylamino-7-(o-fluoroanilino)fluoran,
3-di-n-penthylamino-6-methyl-7-anilinofluoran,
3-di-n-penthylamino-7-(m-trifluoromethylanilino)fluoran,
3-pyrrolidino-6-methyl-7-anilinofluoran,
3-piperidino-6-methyl-7-anilinofluoran,
3-(N-methyl-N-propylamino)-6-methyl-7-anilinofluoran,
3-(N-methyl-N-cyclohexylamino)-6-methyl-7-anilinofluoran,
3-(N-ethyl-p-toluidino)-6-methyl-7-anilinofluoran,
3-(N-ethyl-N-isoamylamino)-6-methyl-7-anilinofluoran,
3-(N-ethyl-N-tetrahydrofurfurylamino)-6-methyl-7-anilinofluoran,
3-(N-ethyl-N-isobutylamino)-6-methyl-7-anilinofluoran,
3-(N-ethyl-N-ethoxypropylamino)-6-methyl-7-anilinofluoran and
2,4-dimethyl-6-[(4-dimethylamino)anilino]-fluoran however the invention is, not limited to them. And these leuco dyes can be used alone or can be used together.

As an organic color developer which can be used in this invention, bis-phenol A type,
4-hydroxyphthalic acid ester type,
4-hydroxyphthalic acid diester type,
phthalic acid monoester type,
bis-(hydroxyphenyl)sulfide type,
4-hydroxyphenylarylsulfone type,
4-hydroxyphenylarylsulfonate type,
1,3-di[2-(hydroxyphenyl)-2-propyl]benzene type,
4-hydroxybenzoyloxybenzoic acid ester type and bisphenolsulfones which are disclosed in Japanese Patent Laid-Open Publication 3-207688 or Japanese Patent Laid-Open Publication 5-24366, can be mentioned. The typical concrete well known examples are shown below, however it is, not intended to be limited to them. These developers can be used alone or used together.

<bisphenol A type>
4,4'-isopropylidenediphenol (another name is bisphenol A),
4,4'-cyclohexylidenediphenol,
p,p'-(1-methyl-n-hexylidene)diphenol,
1,7-di(hydroxyphenylthio)-3,5-dioxaheptane.
<4-hydroxybenzoic ester type>
4-hydroxybenzyl benzoate,
4-hydroxyethyl benzoate,
4-hydroxypropyl benzoate,
4-hydroxyisopropyl benzoate,
4-hydroxybutyl benzoate,
4-hydroxyisobutyl benzoate,
4-hydroxymethylbenzyl benzoate.
<4-hydroxyphthalic acid diester type>
4-hydroxydimethyl phthalate,
4-hydroxydiisopropyl phthalate,
4-hydroxydibenzyl phthalate,
4-hydroxydihexyl phthalate.
<phthalic acid monoester type>
monobenzyl phthalate,
monocyclohexyl phthalate,
monophenyl phthalate,
monomethylphenyl phthalate,
monoethylphenyl phthalate,
monopropylbenzyl phthalate,
monohalogenbenzyl phthalate,
monoethoxybenzyl phthalate.
<bis-(hydroxyphenyl)sulfide type>
bis-(4-hydroxy-3-tert-butyl-6-methylphenyl)sulfide,
bis-(4-hydroxy-2,5-dimethylphenyl)sulfide,
bis-(4-hydroxy-2-methyl-5-ethylphenyl)sulfide,
bis-(4-hydroxy-2-methyl-5-isopropylphenyl)sulfide,
bis-(4-hydroxy-2,3-dimethylphenyl)sulfide,
bis-(4-hydroxy-2,5-dimethylphenyl)sulfide,
bis-(4-hydroxy-2,5-diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)sulfide,
bis-(2,3,4-trihydroxyphenyl)sulfide,
bis-(4,5-dhydroxy-2-tert-butylphenyl)sulfide,
bis-(4-hydroxy-2,5-diphenylphenyl)sulfide,
bis-(4-hydroxy-2-tert-octyl-5-methylphenyl)sulfide.
<4-hydroxyphenylarylsulfone type>
4-hydroxy-4'-isopropoxydiphenylsulfone,
4-hydroxy-4'-n-butyloxydiphenylsulfone,
4-hydroxy-4'-n-propoxydiphenylsulfone.
<4-hydroxyphenylarylsulfonate type>
4-hydroxyphenylbenzenesulfonate,
4-hydroxyphenyl-p-tolylsulfonate,
4-hydroxyphenylmethylenesulfonate,
4-hydroxyphenyl-p-chlorobenzenesulfonate,
4-hydroxyphenyl-p-tert-butylbenzenesulfonate,
4-hydroxyphenyl-p-isopropoxybenzenesulfonate,
4-hydroxyphenyl-1'-naphthalenesulfonate,
4-hydroxyphenyl-2'-naphthalenesulfonate.
<1,3-di[2-(hydroxyphenyl-2-propyl]benzene type>
1,3-di[2-(4-hydroxyphenyl-2-propyl]benzene,
1,3-di[2-(4-hydroxy-3-alkylphenyl)-2-propyl]benzene,
1,3-di[2-(2,4-dihydroxyphenyl-2-propyl]benzene, 1,3-di[2-(2-hydroxy-5-methylphenyl-2-propyl]benzene.
<resorcinol type>
1,3-dihydroxy-6(α,α-dimethylbenzyl-benzene.
<4-hydroxybenzoyloxybenzoic acid ester type>
4-hydroxybenzoyloxybenzyl benzoate,
4-hydroxybenzoyloxymethyl benzoate,
4-hydroxybenzoyloxyethyl benzoate,
4-hydroxybenzoyloxypropyl benzoate,
4-hydroxybenzoyloxybutyl benzoate,
4-hydroxybenzoyloxyisopropyl benzoate,
4-hydroxybenzoyloxytert-butyl benzoate,
4-hydroxybenzoyloxyhexyl benzoate,
4-hydroxybenzoyloxyoctyl benzoate,
4-hydroxybenzoyloxynonyl benzoate,
4-hydroxybenzoyloxycyclohexyl benzoate,
4-hydroxybenzoyloxyβ-phenethyl benzoate,
4-hydroxybenzoyloxyphenyl benzoate,
4-hydroxybenzoyloxyα-naphthyl benzoate,
4-hydroxybenzoyloxyβ-naphthyl benzoate,
4-hydroxybenzoyloxysec-butyl benzoate
<bisphenolsulfone type (I)>
bis-(3-1-butyl-4l-hydroxy-6-methylphenyl)sulfone,
bis-(3-ethyl-4-hydroxyphenyl)sulfone,
bis-(3-propyl-4-hydroxyphenyl)sulfone,
bis-(3-methyl-4-hydroxyphenyl)sulfone,
bis-(2-isopropyl-4-hydroxyphenyl)sulfone,
bis-(2-ethyl-4-hydroxyphenyl)sulfone,
bis-(3-chloro-4-hydroxyphenyl)sulfone,
bis-(2,3-dimethyl-4-hydroxyphenyl)sulfone,
bis-(2,5-dimethyl-4-hydroxyphenyl)sulfone,
bis-(3-methoxy-4-hydroxyphenyl)sulfone,
4-hydroxyphenyl-2'-ethyl-4'-hydroxyphenylsulfone,
4-hydroxyphenyl-2'-isopropyl-4'-hydroxyphenylsulfone,
4-hydroxyphenyl-3'-isopropyl-4'-hydroxyphenylsulfone,
4-hydroxyphenyl-3'-sec-butyl-4'-hydroxyphenylsulfone,
3-chloro-4-hydroxyphenyl-3'-isopropyl-4'-hydroxyphenylsulfone,
2-hydroxy-5-t-butylphenyl-4'-hydroxyphenylsulfone,
2-hydroxy-5-t-aminophenyl-4'-hydroxyphenylsulfone,
2-hydroxy-5-t-isopropylphenyl-4'-hydroxyphenylsulfone,
2-hydroxy-5-t-octylphenyl-4'-hydroxyphenylsulfone,
2-hydroxy-5-t-butylphenyl-3'-chloro-4'-hydroxyphenylsulfone,
2-hydroxy-5-t-butylphenyl-3'-methyl-4'-hydroxyphenylsulfone,
2-hydroxy-5-t-butylphenyl-3'-isopropyl-4'-hydroxyphenylsulfone,
2-hydroxy-5-t-butylphenyl-2'-methyl-4'-hydroxyphenylsulfone.
<bisphenolsulfone type (II)>
4,4'-sulfonyldiphenol,
2,4'-sulfonyldiphenol,
3,3'-dichloro-4,4'-sulfonyldiphenol,
3,3'-dibromo-4,4'-sulfonyldiphenol,
3,3',5,5'-tetrabromo-4,4'-sulfonyldiphenol,
3,3'-diamino-4,4'-sulfonyldiphenol.
<others>
p-tert-butylphenol,
2,4-dihydroxybenzophenone,
novolac type phenolic resin,
4-hydroxyacetophenone,
p-phenylphenol,
benzyl-4-hydroxyphenylacetate,
p-benzylphenol.

In the present invention, since the use of a color developer which has plural phenolic hydroxyl groups causes a problem of ground color contamination (ground color developing) by aqueous coating or by humidity in atmosphere, monophenol type color developer is preferably usedd when more high ground color stability is required. Especially, monophenol sulfone type color developer represented by above mentioned 4-hydroxyphenylarylsulfone contains sulfonyl group in its molecule. A strong electron accepting portion is formed by an electron attractive force of this sulfonyl group, and indicates strong reactivity with dye precursor and performs an excellent color developing ability, further the obtained thermally recording medium is also superior to the stability of ground color.

In this invention, a conventional well known sensitizer can be used as long as the desired effect of this invention is not prevented. As examples of the sensitizer,
stearic acid amide,
palmitic acid amide,
methoxycarbonyl-N-benzamidestearate,
N-benzoylstearic acid amide,
N-eicosenoic acid amide,
ethylene-bis-stearic acid amide,
behenic acid amide,
methylene-bis-stearic acid amide,
methylolamide,
N-methylolstearic acid amide,
dibenzyl terephthalate,
dimethyl terephthalate,
dioctyl terephthalate,
p-benzyloxybenzylbenzoate,
1-hydroxy-2-phenylnaphthoate,
dibenzyloxalate
di-p-methylbenzyloxalate,
di-p-chlorobenzyloxalate,
2-naphthylbenzylether,
m-terphenyl,
p-benzylbiphenyl,
4-biphenyl-p-tolylether
di(p-methoxyphenoxyethyl)ether
1,2-di(3-methylphenoxy)ethane
1,2-di(4-methylphenoxy)ethane
1,2-di(4-methoxyphenoxy)ethane
1,2-di(4-chlorophenoxy)ethane
1,2-diphenoxyethane
1-(4-methoxyphenoxy)-2-(2-methylphenoxy)ethane
p-methylthiophenylbenzylether
1,4-di(phenylthio)buthane
p-acetotoluidide
p-acetophenetidide,
N-acetoacetyl-p-toluidine,
di-(β-biphenylethoxy)benzene,
p-di(vinyloxyethoxy)benzene,
1-isopropylphenyl-2-phenylethane
1,2-bis(phenoxymethyl)benzene
p-toluenesulfonamide,
o-toluenesulfonamide,
di-p-tolylcarbonate and
phenyl-α-naphtylcarbonate
can be mentioned, however it is not intended to be limited to these compounds. These sensitizers can be used alone or by mixing more than two kinds of them.

As the binder used in the present invention, full saponified polyvinyl alcohol of 200–1900 polymerization degree, partial saponified polyvinyl alcohol, denatured polyvinyl alcohol by carboxyl, denatured polyvinyl alcohol by amide, denatured polyvinyl alcohol by sulfonic acid and denatured polyvinyl alcohol by butyal, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetate, polyacrylamide, polyacrylic acid ester, polyvinylbutyal, polystyrene or copolymer of them, polyamide resin, silicon resin, petroleum resin, terpene resin, ketone resin and cumarone resin can be illustrated. These macromolecular compounds can be applied by being dissolved into solvents such as water, alcohol, ketone, ester or hydrocarbon or by being dispersed in water or other medium under an emulsion state or a paste state and these forms of application can be used in combination according to the quality requirement.

In the present invention, it, is also possible to add known stabilizers based on metal salts (Ca, Zn) of p-nitrobenzoic acid or metal salts (Ca, Zn) of monobenzylphthalate, which have an effect to endow the recorded image with oil resistance, so long as the desired effect on the object of the present invention is not hindered.

As a filler which can be used in this invention, an inorganic or an organic filler such as silica, calcium carbonate, kaoline, calcined kaoline, diatomaceous earth, talc, titanium oxide, zinc oxide, aluminum hydroxide, polystyrene resin, urea-formaldehyde resin, copolymer of styrene-methacrylic acid, copolymer of styrene-butadiene and hollow plastic pigment can be mentioned.

Further, a parting agent such as metallic salt of fatty acid, a slipping agent such as wax, bezophenone or triazole-based ultraviolet absorbers, water proof agent such as glyoxal, dispersing agent, defoamers, anti-oxidation agent and fluorescent dye can be used as an additive.

As a substrate, paper, synthetic paper, plastic film, plastic foam film, non-woven fabric, recycled paper, metallic foil and a complex of these material can be used.

Further, for the purpose to improve a friction resistance and an image preserving ability, an overcoat layer composed by high polymer composition can be prepared on the surface of thermally sensitive color developing layer. Furthermore, for the purpose to improve the color sensitivity, an undercoat layer containing organic or inorganic filler can be prepared between color developing layer and substrate.

The amount of color developer and dye precursor, the kind and amount of other additives to be used for the thermally sensitive recording medium of this invention are decided according to the required quality and recording feature, and are not restricted. However, in general, it is preferable to use 0.5–4 parts of filler to 1 part of color developer and 5–25 % of binder to the total amount of solid. When 3,3-bis(p-dimethylaminophenyl-6-dimethylaminophthalide or 3-(4-diethylamino-2-ethoxyphenyl)-3-(1-ethyl-2-methylindol-3-il)-4-azaphthalide which are used as the blue color developing leuco dye and the black color developing leuco dye whose maximum absorption wave length is 420–480 nm and 550–640 nm as a dye precursor are used, the mixing ratio is decided by the required color tone, however, it is desirable to contain 0.05–1 parts of black color developing leuco dye to 1 part of blue color developing leuco dyes and the desirable total parts of these leuco dye is 0.1–2 parts to 1 part of organic color developer. The color tone of developed image slightly changes by a stabilizer, a sensitizer and other additives, however the influence of it is not so remarkable.

These color developer, dye and other additives which are added at need are ground to the fine particles smaller than several microns diameter by means of a pulverizer such as a ball mill, an attriter or a sand grinder, or by means of an adequate emulsifying apparatus, then binder and other additives are added at need, thus the coating is prepared. As a method to apply the coating, a hand coating, a size press coating method, a roll coating method, an air knife coating method, a blend coating method, a flow coating method, a comma direct method, a gravure direct method, a gravure reverse method and a reverse-roll coating method can be mentioned. Further, the method to dry up after sputtering, spraying or dipping can also be used.

EXAMPLES AND COMPARATIVE EXAMPLES

Preparation of Thermally Sensitive Recording Medium

The spontaneously color changing type thermally sensitive recording media of this invention is illustrated by following Examples. In Examples, terms of parts and % indicate parts by weight and weight %.

Example 1

Example 1 is an example of the thermally sensitive recording medium of this invention in which 4,4'-isopropylidenediphenol (bisphenol A, shortened to a in Table 1) is used as a color developer, 3,3-bis(p-dimethylaminophenyl)-6-dimethyl phthalide (shortened to C-1 in Table 1) is used as a blue color developing leuco dye and 3-dibutyl-6-methyl-7-anilinofluoran (shortened to B-1 in Table 1) is used as a black color developing dye whose maximum absorption wave length is 420–480 nm and 550–640 nm.

Dispersion of color developer (A solution), dispersion of a blue color developing leuco dye (B solution) and a black color developing leuco dye (C solution) of following blending proportion are separately ground in a wet condition to average diameter of 1 $\mu$m by means of a sand grinder.

A solution (dispersion of color developer)

| | |
|---|---|
| 4,4'-isopropylidenediphenol (a) | 6.0 parts |
| 10% aqueous solution of polyvinylalcohol | 18.8 parts |
| water | 11.2 parts |

B solution (dispersion of blue color developing leuco dye)

| | |
|---|---|
| 3,3-bis(p-dimethylaminophenyl)-6-dimethylaminophthalide (C-1) | 1.0 parts |
| 10% aqueous solution of polyvinylalcohol | 2.3 parts |
| water | 1.3 parts |

C solution (dispersion of black color developing leuco dye)

| | |
|---|---|
| 3-dibutylamino-6-methyl-7-anilinofluoran (B-1) | 1.0 parts |
| 10% aqueous solution of polyvinylalcohol | 2.3 parts |
| water | 1.3 parts |

Then the resulting dispersions are mixed together in the proportion indicated below, mixed and the coating is prepared.

| | |
|---|---|
| A solution (dispersion of color developer [a]) | 36.0 parts |

-continued

| | |
|---|---|
| B solution (dispersion of blue color developing leuco dye [C-1]) | 10.58 parts |
| C solution (dispersion of black color developing leuco dye [B-1]) | 3.22 parts |
| Kaoline clay (50% dispersion) | 12.0 parts |

The prepared coating is applied to one side of 50 g/m$^2$ substrate paper and dried up, then the sheet is processed by a super calendar to surface smoothness of 500–600 second and the thermally sensitive recording media of 6.0 g/m$^2$ coating amount can be obtained.

Examples 2–5

The thermally sensitive recording media are prepared by the same procedure as Example 1. At the preparation of A solution, 4-hydroxy-4'-isopropoxydiphenylsulfone (shortened to b; Example 2), 4-hydroxy-4'-propoxydiphenylsulfone (shortened to c; Example 3), 4-hydroxybenzoic acid benzyl ester (shortened to d; Example 4) and 4,4'-dihydroxydiphenylsulfone (shortened to e; Example 5) are used instead of 4,4'-isopropylidendiphenol (a)

Example 6

The thermally sensitive recording media is prepared by the same procedure as Example 1. As the color developer, 4,4'-isopropylidenediphenol (a) and 4-hydroxy-4'-isopropoxydiphenylsulfone (b) are use. The mixing proportion of dispersion is mentioned below, stirred and the coating is prepared.

| | |
|---|---|
| A solution (dispersion of color developer [a]) | 18.0 parts |
| A solution (dispersion of color developer [b]) | 18.0 parts |
| B solution (dispersion of blue color developing leuco dye [C-1]) | 10.58 parts |
| C solution (dispersion of black color developing leuco dye [B-1]) | 3.22 parts |
| Kaoline clay (50% dispersion) | 12.0 parts |

Example 7

The thermally sensitive recording media is prepared by the same procedure as Example 2. At the preparation of B solution, 3-(4-diethylamino-2-ethoxyphenyl)-3-(1-ethyl-2-methylindol-3-yl)-4-azaphthalide (C-2) is used as the blue leuco dye instead of 3,3-bis(p-dimethylaminophenyl)-6-dimethylamino phthalide (C-1).

Example 8

The thermally sensitive recording media is prepared by the same procedure as Example 2. As the blue leuco dye, 3,3-bis(p-dimethylaminophenyl)-6-dimethylaminophthalide (C-1) and 3-(4-diethyl amino-2-ethoxyphenyl)-3-(1-ethyl-2-methylindol-3-yl)-4-azaphthalide (C-2) are used. The mixing proportion of dispersion is mentioned below, and mixed, stirred and the coating is prepared.

| | |
|---|---|
| A solution (dispersion of color developer [a]) | 36.0 parts |
| B solution (dispersion of blue color developing leuco dye[C-1]) | 5.29 parts |
| B solution (dispersion of blue color developing leuco dye [C-2]) | 5.29 parts |
| C solution (dispersion of black color developing leuco dye [B-1]) | 3.22 parts |
| Kaoline clay (50% dispersion) | 12.0 parts |

Examples 9–14

The thermally sensitive recording media are prepared by the same procedure as Example 2. At the preparation of C solution, 3-(N-ethyl-N-isoamylamino)-6-methyl-7-anilinofluoran (shortened to B-2; Example 9), 3-diethylamino-6-methyl-7-anilinofluoran (shortened to B-3; Example 10) 3-diethylamino-7-(m-trifluoromethylanilino)fluoran (shortened to B-4; Example 11), 3-diethylamino-6-methyl-7-m-methylanilinofluoran (shortened to B-5; Example 12), 3-(N-methyl-N-propylamino)-6-methyl-7-anilinofluoran (shortened to B-6; Example 13) and 3-(di-n-pentylamino-6-methyl-7-anilinofluoran (shortened to B-7, Example 14) are used instead of 3-dibutylamino-6-methyl-7-anilinofluoran (B-1).

Example 15

The thermally sensitive recording media is prepared by the same procedure as Example 2. As the black color developing leuco dye, 3-dibutyl-6-methyl-7-anilinofluoran (B-1) and 3-(N-ethyl-N-isoamylamino)-6-methyl-7-anilinofluoran (shortened to B-2) are used. The mixing proportion of dispersion is mentioned below, and mixed, stirred and the coating is prepared.

| | |
|---|---|
| A solution (dispersion of color developer [a]) | 36.0 parts |
| B solution (dispersion of blue color developing leuco dye[C-1]) | 10.58 parts |
| C solution (dispersion of black color developing leuco dye [B-1]) | 1.61 parts |
| C solution (dispersion of black color developing leuco dye [B-2]) | 1.61 parts |
| Kaoline clay (50% dispersion) | 12.0 parts |

Example 16

The thermally sensitive recording media is prepared by the same procedure as Example 9. The mixing proportion of dispersion is mentioned below, mixed and stirred and the coating is prepared.

| | |
|---|---|
| A solution (dispersion of color developer [a]) | 36.0 parts |
| B solution (dispersion of blue color developing leuco dye[C-1]) | 12.88 parts |
| C solution (dispersion of black color developing leuco dye [B-2]) | 0.92 parts |
| Kaoline clay (50% dispersion) | 12.0 parts |

Example 17

The thermally sensitive recording media is prepared by the same procedure as Example 9. The mixing proportion of dispersion is mentioned below, mixed and stirred and the coating is prepared.

| | |
|---|---|
| A solution (dispersion of color developer [a]) | 36.0 parts |
| B solution (dispersion of blue color developing leuco dye[C-1]) | 9.2 parts |
| C solution (dispersion of black color developing leuco dye [B-2]) | 4.6 parts |
| Kaoline clay (50% dispersion) | 12.0 parts |

Example 18

The thermally sensitive recording media is prepared by the same procedure as Example 9. The mixing proportion of dispersion is mentioned below, mixed and stirred and the coating is prepared.

| | |
|---|---|
| A solution (dispersion of color developer [a]) | 36.0 parts |
| B solution (dispersion of blue color developing leuco dye[C-1]) | 13.34 parts |
| C solution (dispersion of black color developing leuco dye [B-2]) | 0.46 parts |
| Kaoline clay (50% dispersion) | 12.0 parts |

Example 19

The thermally sensitive recording media is prepared by the same procedure as Example 9. The mixing proportion of dispersion is mentioned below, mixed and stirred and the coating is prepared.

| | |
|---|---|
| A solution (dispersion of color developer [a]) | 36.0 parts |
| B solution (dispersion of blue color developing leuco dye[C-1]) | 5.06 parts |
| C solution (dispersion of black color developing leuco dye [B-2]) | 8.74 parts |
| Kaoline clay (50% dispersion) | 12.0 parts |

Comparative Example 1

The thermally sensitive recording media is prepared by the same procedure as Example 9. At the preparation of coating layer, C solution is not added. The mixing proportion of each dispersion is mentioned below, and mixed, stirred and the coating is prepared.

| | |
|---|---|
| A solution (dispersion of color developer [1]) | 36.0 parts |
| B solution (dispersion of blue color developing leuco dye [C-1]) | 13.8 parts |
| Kaoline clay (50% dispersion) | 12.0 parts |

Comparative Example 2

The thermally sensitive recording media is prepared by the same procedure as Example 9. At the preparation of coating layer, B solution is not added. The mixing proportion of each dispersion is mentioned below, and mixed, stirred and the coating is prepared.

| | |
|---|---|
| A solution (dispersion of color developer [b]) | 36.0 parts |
| C solution (dispersion of black color developing leuco dye [B-2]) | 13.8 parts |
| Kaoline clay (50% dispersion) | 12.0 parts |

Method for Estimation

Using a thermally sensitive printer TH-PMD (product of Ohkura Electric Co., Ltd. Thermally recording paper printing tester in which Kyocera Thermal head is installed) recording tests are carried out on prepared spontaneously color changing type thermally sensitive recording medium by 0.41 mj/dot impressive energy. The color differences L*, a* and b* value as set forth in JIS-Z-8729 are measured by color tone difference meter (NF-999; product, of Nihon Denshoku Kogyo Co., Ltd.). Further, the density of developed color (O.D. in Table 2) is measured by Macbeth densitometer (RD-914, red filter is used). The obtained results are summarized in Table 1 and Table 2. In Table 1, numerical value in parenthesis shows the blending proportion of a black color developing dye to a blue color developing dye.

TABLE 1

Kinds of color developer and dye

| | color | color developing dye | |
|---|---|---|---|
| experiment No. | developer | blue | black |
| Example 1 | a | C-1 | B-1(0.3) |
| Example 2 | b | C-1 | B-1(0.3) |
| Example 3 | c | C-1 | B-1(0.3) |
| Example 4 | d | C-1 | B-1(0.3) |
| Example 5 | e | C-1 | B-1(0.3) |
| Example 6 | a/b | C-1 | B-1(0.3) |
| Example 7 | b | C-2 | B-1(0.3) |
| Example 8 | b | C-1/C-2 | B-1(0.3) |
| Example 9 | b | C-1 | B-2(0.3) |
| Example 10 | b | C-1 | B-3(0.3) |
| Example 11 | b | C-1 | B-4(0.3) |
| Example 12 | b | C-1 | B-5(0.3) |
| Example 13 | b | C-1 | B-6(0.3) |
| Example 14 | b | C-1 | B-7(0.3) |
| Example 15 | b | C-1 | B-1/B-2(0.3) |
| Example 16 | b | C-1 | B-2(0.07) |
| Example 17 | b | C-1 | B-2(0.5) |
| Example 18 | b | C-1 | B-2(0.03) |
| Example 19 | b | C-1 | B-2(1.7) |
| Comp. Example 1 | b | C-1 | — |
| Comp. Example 2 | b | — | B-2 |

TABLE 2

L*, a*, b*value, tone and density after printed

| experiment No. | L* | a* | b* | color tone | O.D. |
|---|---|---|---|---|---|
| Example 1 | 30.5 | −5.1 | −0.6 | grayish blue | 1.27 |
| Example 2 | 38.5 | −0.7 | 0.1 | grayish blue | 1.25 |
| Example 3 | 34.7 | 4.2 | −1.7 | grayish blue | 1.23 |
| Example 4 | 36.0 | −2.1 | 0.4 | grayish blue | 1.28 |
| Example 5 | 39.0 | −0.9 | −0.3 | grayish blue | 1.25 |
| Example 6 | 32.6 | 1.8 | −0.4 | grayish blue | 1.26 |
| Example 7 | 30.4 | 6.8 | −0.8 | dark blue | 1.30 |
| Example 8 | 35.3 | 2.3 | −0.5 | navy blue | 1.29 |
| Example 9 | 39.4 | −2.5 | −0.1 | grayish blue | 1.30 |
| Example 10 | 30.6 | −4.5 | −0.5 | grayish blue | 1.29 |

TABLE 2-continued

L*, a*, b*value, tone and density after printed

| experiment No. | L* | a* | b* | color tone | O.D. |
|---|---|---|---|---|---|
| Example 11 | 30.0 | −3.5 | −1.9 | grayish blue | 1.28 |
| Example 12 | 31.0 | −6.0 | −0.9 | grayish blue | 1.30 |
| Example 13 | 33.0 | −8.1 | 3.4 | grayish blue | 1.27 |
| Example 14 | 33.1 | −7.1 | 3.5 | grayish blue | 1.26 |
| Example 15 | 39.1 | −1.7 | 0.1 | grayish blue | 1.30 |
| Example 16 | 40.7 | 2.1 | −15.7 | grayish blue | 1.32 |
| Example 17 | 35.4 | −5.6 | 2.2 | grayish blue | 1.26 |
| Example 18 | 40.8 | 3.1 | −20.2 | bright grayish blue | 1.34 |
| Example 19 | 31.4 | −8.9 | 5.3 | dark grayish blue | 1.24 |
| Comp. Example 1 | 46.3 | 36.0 | −69.0 | blue | 1.40 |
| Comp. Example 2 | 26.0 | −1.5 | 1.9 | black | 1.32 |

Evaluation Results

Examples 1–19 of this invention, are examples which use 3,3-bis(p-dimethylaminophenyl)-6-dimethylaminophthalide or 3-(4-diethylamino-2-ethoxy phenyl-3-(1-ethyl-2-methylindol-3-yl)-4-azaphthalide and black color developing leuco dye whose absorption maximum wave length is 420–480 nm and 550–640 nm.

The color differences L* value, a* value and b* value regulated by JIS-Z-8729 of developed image of these Examples are within the regions of, A. L* value is 30–50, a* value is −15–0 and b* value is −30–10, B. L* value is 30–50, a* value is 0–10 and b* value is −30–0 or C. L* value is 30–50, a* value color is 10–20, b* value is −30–15, and the color tone of these Examples are navy blue or grayish blue. On the contrary, color difference a* value and b* value of Comparative Example 1 are out of the region regulated by this invention, and L* value of Comparative Example 2 is out of the region regulated by this invention. In both cases, the aimed color can not be obtained.

Effect of the invention

The thermally sensitive recording media of this invention, has a sufficient color developing density and develops navy blue color or grayish blue color, therefore it is suited to be used in a field where these color tones are desired.

What is claimed is:

1. A thermally sensitive recording medium, comprising a substrate and a thermally sensitive color developing layer developing a navy blue or grayish blue color carried on said substrate, said layer comprising a colorless or pale colored dye precursor and a color developer, wherein the dye precursor comprises (a) at least one bluish color developing leuco dye selected from the group consisting of 3,3-bis(p-dimethylaminophenyl)-6-dimethylaminophthalide, 3-(4-dimethylamino-2-ethoxyphenyl)-3-(1-ethyl-2-methylindol-3-yl)-4-azaphthalide, and mixture thereof, and (b) at least one black color developing leuco dye having maximum absorption wavelengths of from 420 to 480 nm and from 550 to 640 nm.

2. The thermally sensitive recording media for developing a navy blue or grayish blue color according to claim 1, wherein, the color differences L*, a* and b*, as measured by JIS-Z-8729, of the developed image of the thermally sensitive recording medium, are within one of the following ranges of values:

(A) L* from 30 to 50, a* from −15 to 0, and b* from −30 to 10; or (B) L* from 30 to 50, a* from 0 to 10, and b* from −30 to 0; or (C) L* from 30 to 50, a* from 10 to 20, and b* from −30 to −15.

3. The thermally sensitive recording media according to claim 2, which comprises from 0.05 to 1 part of said at least one black color developing leuco dye (b), per 1 part of said at least one bluish color developing leuco dye (a).

4. The thermally sensitive recording media according to claim 2, wherein said at least one black color developing leuco dye comprises at least one compound selected from the group consisting of:

3-diethylamino-6-methyl-7-anilinofluoran, 3-diethylamino-6-methyl-7-(o.p-dimethylanilino)fluoran, 3-diethylamino-6-methyl-7-(p-chloroanilino)fluoran, 3-diethylamino-6-methyl-7-m-methylanilinofluoran, 3-diethylamino-6-methyl-7-n-octylaminofluoran, 3-diethylamino-6-chloro-7-anilinofluoran, 3-diethylamino-7-(m-trifluoromethylanilino)fluoran, 3-diethylamino-7-(o-chloroanilino)fluoran, 3-diethylamino-7-(o-fluoroanilino)fluoran, 3-diethylamino-6-methyl-7-(p-n-butylanilino)fluoran, 3-dibutylamino-6-methyl-7-anilinofluoran, 3-dibutylamino-6-methyl-7-(o.p-dimethylanilino)fluoran, 3-dibutylamino-7-(o-chloroanilino)fluoran, 3-dibutylamino-7-(o-fluoroanilino)fluoran, 3-di-n-penthylamino-6-methyl-7-anilinofluoran, 3-di-n-penthylamino-7-(m-trifluoromethylanilino) fluoran, 3-pyrrolidino-6-methyl-7-anilinofluoran, 3-piperidino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-p-toluidino)-6-methyl-7-anilinofluoran, 3-(N-ethyl-N-isoamylamino)-6-methyl-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N-ethyl-N-ethoxypropylamino)-6-methyl-7-anilinofluoran and 2,4-dimethyl-6-[(4-dimethylamino)anilino]-fluoran.

5. The thermally sensitive recording media according to claim 2, wherein said color developer is at least one type of organic color developer selected from the group consisting of bisphenol A compounds, 4-hydroxyphthalic acid ester compounds, 4-hydroxyphthalic acid diester compounds, phthalic acid monoester compounds, bis-(hydroxyphenyl) sulfide compounds, 4-hydroxyphenylarylsulfone compounds, 1,3-di[2-(hydroxyphenyl)-2-propyl]benzene compounds, 4-hydroxybenzoyloxybenzoic acid ester compounds and bisphenolsulfone compounds.

6. The thermally sensitive recording media according to claim 1, which comprises from 0.05 to 1 part of said at least one black color developing leuco dye (b), per 1 part of said at least one bluish color developing leuco dye (a).

7. The thermally sensitive recording media according to claim 1, wherein said at least one black color developing leuco dye comprises at least one compound selected from the group consisting of:

3-diethylamino-6-methyl-7-anilinofluoran, 3-diethylamino-6-methyl-7-(o.p-dimethylanilino)fluoran, 3-diethylamino-6-methyl-7-(p-chloroanilino)fluoran, 3-diethylamino-6-methyl-7-m-methylanilinofluoran, 3-diethylamino-6-methyl-7-n-octylaminofluoran, 3-diethylamino-6-chloro-7-anilinofluoran, 3-diethylamino-7-(m-trifluoromethylanilino)fluoran, 3-diethylamino-7-(o-chloroanilino)fluoran, 3-diethylamino-7-(o-fluoroanilino)fluoran, 3-diethylamino-6-methyl-7-(p-n-butylanilino)fluoran, 3-dibutylamino-6-methyl-7-anilinofluoran, 3-dibutylamino-6-methyl-7-(o.p-dimethylanilino)fluoran, 3-dibutylamino-7-(o-chloroanilino)fluoran, 3-dibutylamino-7-(o-fluoroanilino)fluoran, 3-di-n-penthylamino-6-methyl-7-anilinofluoran, 3-di-n-penthylamino-7-(m-trifluoromethylanilino) fluoran, 3-pyrrolidino-6-methyl-7-anilinofluoran, 3-piperidino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-p-toluidino)-6-methyl-7-anilinofluoran, 3-(N-ethyl-N-isoamylamino)-6-methyl-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N-ethyl-N-ethoxypropylamino)-6-methyl-7-anilinofluoran and 2,4-dimethyl-6-[(4-dimethylamino)anilino]-fluoran.

8. The thermally sensitive recording media according to claim 1, wherein said color developer is at least one type of organic color developer selected from the group consisting of bisphenol A compounds, 4-hydroxyphthalic acid ester compounds, 4-hydroxyphthalic acid diester compounds, phthalic acid monoester compounds, bis-(hydroxyphenyl) sulfide compounds, 4-hydroxyphenylarylsulfone compounds, 1,3-di[2-(hydroxyphenyl)-2-propyl]benzene compounds, 4-hydroxybenzoyloxybenzoic acid ester compounds and bisphenolsulfone compounds.

9. The thermally sensitive recording media according to claim 1, wherein said color developer is at least one compound selected from the group consisting of 4-hydroxy-4'isopropoxydiphenylsulfone, 4-hydroxy-4'-n-butyloxydiphenylsulfone, and, 4-hydroxy-4'-n-propoxydiphenylsulfone.

10. The thermally sensitive recording media according to claim 2, wherein said color developer is at least one compound selected from the group consisting of 4-hydroxy-4'isopropoxydiphenylsulfone, 4-hydroxy-4'-n-butyloxydiphenylsulfone, and, 4-hydroxy-4'-n-propoxydiphenylsulfone.

* * * * *